US006254731B1

(12) United States Patent
Puurtinen et al.

(10) Patent No.: US 6,254,731 B1
(45) Date of Patent: Jul. 3, 2001

(54) STEAM BOX INCLUDING A SUCTION ZONE IN AN AREA OF A WEB ADJACENT TO EDGE CUTTER DEVICES

(75) Inventors: Ari Puurtinen; Mika Viertola, both of Jyväskylä ; Jan Lindström, Naantali; Lars Håkan Mikael Hannus, Turku, all of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 08/998,438

(22) Filed: Dec. 26, 1997

(30) Foreign Application Priority Data

Dec. 31, 1996 (FI) ..... 965275
Dec. 31, 1996 (FI) ..... 965276

(51) Int. Cl.[7] ..... D21F 1/48; D21F 1/56; D21F 5/00

(52) U.S. Cl. ..... 162/286; 162/290; 162/297; 162/306; 162/307; 162/310; 162/353

(58) Field of Search ..... 162/195, 290, 162/307, 310, 353, 297, 286, 359, 306

(56) References Cited

U.S. PATENT DOCUMENTS 3,351,521 * 11/1967 Murray et al. ..... 162/307
4,560,438 * 12/1985 Tell et al. ..... 162/195

* cited by examiner

*Primary Examiner*—Steve Alvo
(74) *Attorney, Agent, or Firm*—Steinberg & Raskin, P.C.

(57) ABSTRACT

A steam box including a steam chamber for blowing steam toward a paper or board web that runs on support of a wire and a suction zone arranged at the trailing side of the steam chamber of the steam box for providing suction of steam mist discharged by the steam chamber. The suction zone extends to sides of the steam chamber so as to extend to the lateral areas of the web. The steam box includes edge cutter devices arranged in the area of effect of the suction zone extending to the lateral areas of the web, so as to remove the fibers and fillers produced during the edge cutting and prevent soiling of the edges of the steam box.

15 Claims, 2 Drawing Sheets

STEAM BOX INCLUDING A SUCTION ZONE IN AN AREA OF A WEB ADJACENT TO EDGE CUTTER DEVICES

FIELD OF THE INVENTION

The present invention relates to a steam box for use, e.g., in a paper or board machine, which comprises a steam chamber for blowing steam toward a paper or board web that runs on support of a wire and a suction zone arranged at the trailing side of the steam chamber of the steam box to provide suction for steam mist.

BACKGROUND OF THE INVENTION

In the prior art, a steam box is known which is used in connection with a board or paper machine and through which hot steam is passed into connection with a board or paper web in order to reduce the viscosity of the water contained in the web and thereby to improve the removal of water from the web, i.e., increase the dry solids in the web. Steam boxes are used for the above-mentioned purpose, for instance, in wire and press sections of a board or paper machine.

One particular problem in the steam boxes used in wire sections is the blowing-out of non-condensing steam from the active area of the steam box which wets the structures in the press section and even in the entire paper machine hall. This mist cloud of non-condensing steam produced by the blowing-out of steam from the steam box causes, in the worst cases, even water to drip from the ceiling of the machine hall. Steam blows out mainly from the trailing edge of the steam box and to some extent from the sides of the steam box.

In view of this blowing phenomenon, the capacity of the whole steam box cannot be used efficiently for increasing dry solids in the web because in that case, the formation of mist is intense and the structures of the machine become too wet. One solution to this problem known from the prior art is to provide for suction on the trailing side of the steam box. However, this has not made it possible to sufficiently eliminate the spreading of steam as mist to surrounding structures and the machine hall, and thus it has nevertheless been necessary to operate the steam box at reduced capacity because of the blowing-out of steam from the active area of the steam box.

As another solution to this problem, attempts have also been made to arrange general exhausts in the area of the wire section. However, this has not made it possible to sufficiently prevent the spreading of steam and its condensation on structures and the resulting dripping of water therefrom.

Another serious problem in the steam box of a wire section is keeping the steam box clean in the area of edge cutting, i.e., in the vicinity of the cutting means which cut the lateral areas of the web along the width thereof to form edges of the web. During edge cutting, fibers and fillers become separated from the web and they adhere to and accumulate on the edges of the steam box and drop therefrom onto the web causing runnability problems and even web breaks on some machines.

This has led to the fact that it has been necessary to place the edge cutting devices far from the headbox which, however, cannot always be done because of lack of space, and thus it may have been necessary to give up the use of the steam box when increasing drying capacity of the paper or board machine.

Attempts have also been made in the prior art to prevent the soiling problems of the steam box caused by edge cutting by means of an air curtain arranged in front of the steam box. However, this problem will be further aggravated when the running speeds of machines increase and when the aim is to provide machines that are more compact than before.

OBJECTS AND SUMMARY OF THE INVENTION

An object of the invention is to provide a steam box that does not have the problems of prior art steam boxes described above.

Another object of the invention is to provide a steam box in which the problems caused by the blowing-out of steam are eliminated or at least minimized such that, if desired, the steam box can be operated at full capacity.

Still another object of the invention is to provide a steam box in which problems are not caused by the fibers and fillers which become separated during edge cutting.

In order to achieve the objects stated above and others, the steam box according to the invention includes means defining a suction zone on the sides of the steam chamber so as to extend the suction zone to lateral areas or sides of the web, and edge cutter devices arranged in the area of action of the suction zones extending to the sides of the web so as to remove the fibers and fillers produced during the edge cutting in order to prevent soiling of the edges of the steam box. The suction zones on the sides of the web thus extend beyond the transverse locations at which the web is cut.

In accordance with the invention, the suction zone of the trailing side of the steam box is arranged to also extend to the sides of the steam box and edge cutting is performed in the area of the suction zone of the steam box and the fibers and fillers coming off during edge cutting are removed by means of vacuum into the same suction zone as the steam mist.

The steam box in accordance with the invention is suitable for use in connection with both new and existing machines.

In one preferred embodiment of the invention, a blow nozzle is arranged in the steam box at the trailing side of the suction zone of the steam box in order to produce a blowing of air so as to prevent spreading of steam mist and to ensure the passage of the steam mist into the suction zone.

In accordance with the invention, a blow nozzle, preferably a foil nozzle directing a blowing against the running direction of the web, is arranged after the suction zone of the trailing side of the steam box in the running direction of the web, which nozzle slows down the flow of steam with the web past the suction zone. Warm air is supplied to the blow nozzle preferably through an end structure insulated by means of a double wall, which end is heated to prevent condensing of steam thereon and dripping of water formed thereby. The steam box in accordance with the invention substantially prevents oil mist from being carried away from the area of the steam box and, at the same time, ensures that the steam mist is passed to an exhaust through the suction zone.

A suction box and a blowing end can be constructed to be in the steam box structure or they can be constructed to form separate units in connection with the steam box.

Thus, the steam box for increasing the removal of water from a web supported on a wire, while keeping the steam box clean, in accordance with the invention includes means defining a steam chamber from which steam is blown toward the web and means defining a suction zone at a trailing side of the steam chamber in a running direction of the web. The suction zone has an area of action from which steam mist is drawn into the suction zone. The steam box also includes means defining lateral suction zones on lateral sides of the steam chamber such that each lateral suction zone extends over a respective lateral area of the web. The lateral suction zones have an area of action from which steam mist is drawn therein. The steam box further includes edge cutter devices arranged adjacent a respective lateral area of the web for cutting the respective lateral area of the web to form edges of the web. Each edge cutter device is arranged to cut the respective lateral area of the web in the area of action of the suction zone and/or the lateral suction zone extending over the respective lateral area of the web such that fibers and fillers produced during the cutting of the lateral areas of the web are drawn into the suction zone and/or lateral suction zones and do not soil the steam box.

The means defining the suction zone and the means defining the lateral suction zones may comprise a single frame such that a continuous suction zone is formed extending from one lateral side of the steam chamber to the trailing side of the steam chamber to the other lateral side of the steam chamber and a continuous area of action is formed extending over the lateral areas of the web and the web at the trailing side of the steam chamber. In other words, the means defining the suction zone may encompass the means defining the lateral suction zones.

The means defining the steam chamber, the means defining the suction zone, the means defining the lateral suction zones and a first blow nozzle of the steam box, which is arranged at a trailing side of the suction zone for blowing a medium toward the web to direct the steam mist into the suction zone, may be formed in a single frame. In the alternative, the means defining the steam chamber, the means defining the suction zone, which encompass the means defining the lateral suction zones, and the first blow nozzle are formed out of separate frames and connected together into a substantially unified frame assembly. The steam box may include a second blow nozzle arranged at a leading side of the steam chamber in the running direction of the web for directing a medium toward the web, also to prevent spreading of the steam mist.

An arrangement for removing water from a web and cutting the web in accordance with the invention includes a suction roll having a first suction zone through which suction is applied, a wire arranged to carry the web over the suction roll such that the web is subjected to suction in the first suction zone, and a steam box as described herein.

Another arrangement for removing water from a web and cutting the web in accordance with the invention includes a suction flatbox arranged to applying suction, a wire arranged to carry the web over the suction flatbox such that the web is subjected to the suction applied by the suction flatbox, and a steam box as described herein.

The method for removing water from a web supported on a wire and cutting the web in accordance with the invention comprises the steps of directing steam from a steam chamber toward the web, applying suction to the web from a suction zone situated at a trailing side of the steam chamber in a running direction of the web, applying suction to the web from lateral suction zones situated on lateral sides of the steam chamber such that each lateral suction zone extends over a respective lateral area of the web, and cutting lateral areas of the web to form edges of the web by means of first and second edge cutter devices arranged adjacent a respective lateral area of the web for cutting the respective lateral area of the web. Each edge cutter device is arranged to cut the respective lateral area of the web in an area of action of the suction zone and/or the lateral suction zone extending over the respective lateral area of the web such that fibers and fillers produced during the cutting of the lateral areas of the web are drawn into the suction zone and/or lateral suction zones and do not soil the steam box.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
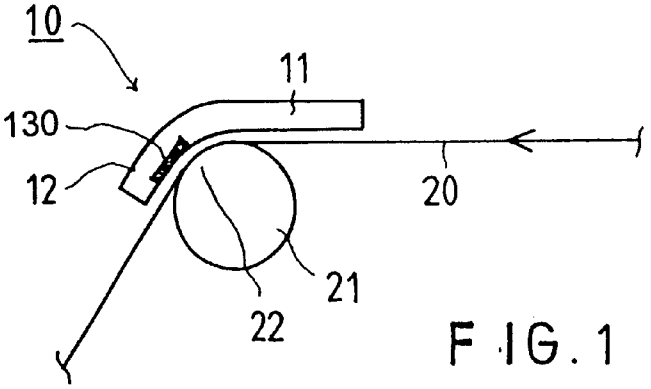
FIG. 1 shows a steam box in accordance with the invention placed in connection with a suction roll of a wire section, viewed schematically from the side.

Referring to FIGS. 1–5 wherein like reference numerals refer to the same or similar elements, FIG. 1 schematically shows a steam box 10 in accordance with the invention arranged in connection with a suction roll 21 of a wire 20 in a wire section of a paper or board machine. A suction zone of the suction roll 21 is denoted with reference numeral 22 and is arranged to provide for a suction force to draw water from a web being carried on the wire 20, draw water from the wire 20 if present therein and/or maintain the wire 20 in a run about the suction roll 21. The steam box 10 comprises means defining a steam chamber 11 into which steam is introduced, or in which steam is generated, and from which the steam is blown toward the web running on the wire 20 in order to increase the removal of water from the web, and means defining a separate suction chamber 12 which has an area of action or effect so that steam in the area of action is sucked or drawn into the suction chamber. The removal of the steam from the vicinity of the web and wire 20 prevents the steam mist from spreading and thus, prevents steam mist from condensing on other structures and accordingly, the dripping of water produced by the condensed steam. Edge cutter devices, by which the lateral areas of the web are cut to form edges of the web, are denoted by reference numeral 130.

Figure 2:
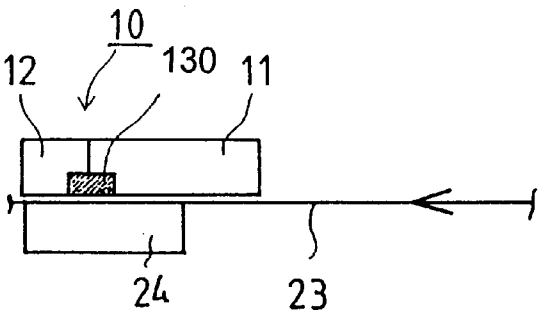
FIG. 2 shows a steam box in accordance with the invention placed in connection with a suction flatbox, viewed schematically from the side.

FIG. 2 schematically shows another embodiment of the invention, in which a steam box 10 is arranged in connection with a suction flatbox 24, i.e., in opposed relationship thereto on an opposite side of the wire 23. Suction flatbox 24 is arranged to provide for a suction force to draw water from the web being carried on the wire 20, draw water from the wire 20 if present therein and/or maintain the web on the wire 20. As in the embodiment of FIG. 1, the steam box 10 comprises means defining a steam chamber 11 and a suction zone 12, such as one or more framed units, and edge cutter devices 130.

Figure 3:
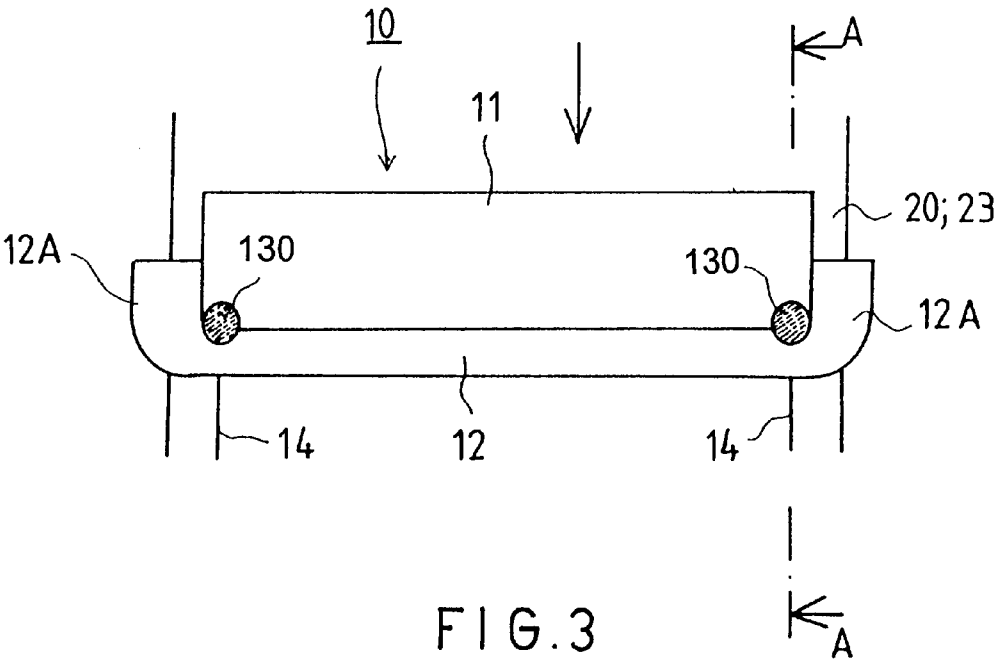
FIG. 3 shows a steam box in accordance with the invention, viewed schematically from above.

FIG. 3 is an illustration of a steam box in accordance with the invention, viewed from above, which steam box may be either one of the embodiments shown in FIGS. 1 or 2. The steam box 10 comprises means defining the steam chamber 11 substantially situated in a middle area of the web and edge cutter devices 130 arranged on each side of the steam chamber II and at a trailing edge thereof The edges of the web are cut by the edge cutter devices 130 along cutting lines 14. The edge cutting may take place in the area of the suction zones of the steam box or in the area of the steam chamber of the steam box, as viewed in the cross direction of the web. On the trailing side in connection with the steam box 10, the suction zone 12 is arranged and also extends to the sides of the steam chamber 11 in the form of side zones 12A, thereby providing a suction zone 12, which, in addition to steam mist, also sucks fibers and fillers produced in edge cutting and thus, prevents the edges of the steam box 10 from getting dirty and soiled. The sides zones 12A of the suction zone 12 extend at least partially along the lateral side of the portion of a frame of the steam box 10 defining the steam chamber 1 so that the area of action of the suction zone 12 includes a portion before the edge cutting devices 130. The edge cutting devices 130 are thus arranged in an area of action of the suction zone 12 so that the fibers and fillers generated during the edge cutting of the web are drawn into the suction zone 12.

Figure 4:
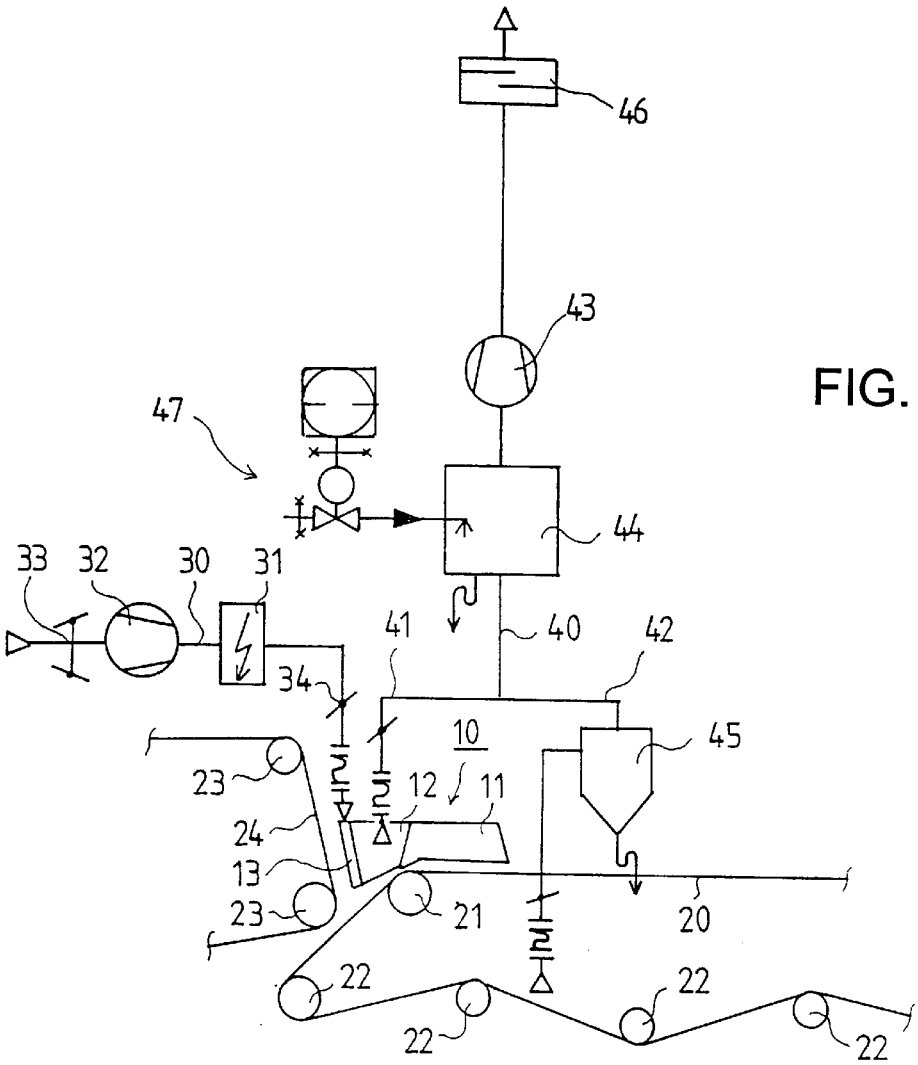
FIG. 4 schematically shows a steam box in accordance with the invention placed in connection with a suction roll of a wire section.

As shown in FIG. 4, a steam box 10 in accordance with the invention is placed in a wire section in connection with a suction roll 21. The wires of the wire section are denoted by reference numerals 20,24 and their guide rolls are denoted by reference numerals 22,23, respectively. The steam chamber 11 of the steam box 10 blows steam towards a web running on support of the wire 20 and, from the trailing side of the steam chamber 11, steam mist which is blowing out is sucked into a suction zone 12 having a blow nozzle 13 arranged in connection therewith and preferably at a trailing side of the suction zone 12. A blowing of a medium such as heated air is blown through the blow nozzle 13 toward the web. The blow nozzle 13 is preferably a foil nozzle blowing against the direction of running of the web and the wire 20, in order to prevent spreading of the steam mist and direct the steam mist into the suction zone 12.

An air system 30 for supplying air or another medium to the blow nozzle 13 comprises ducts and necessary regulation members 33,34, a blower 32 and an air heater 31. A blowing of medium, preferably heated air, is blown through the blow nozzle 13 so as to prevent spreading of steam and to ensure that the steam is carried to the suction zone 12. The blow nozzle 13 is also preferably provided with double walls to maintain the heat of the air and prevent condensation of steam thereon. Air is removed from the suction zone 12 through a duct 41 in flow communication therewith into an exhaust system 40, into which exhaust air is also passed from an exhaust of the wire section along a duct 42. The system may comprise droplet and/or pulp separators 44,45 and it has a blower 43 and a sound attenuator 46. The washing system of the droplet and/or pulp separator 44 is denoted by reference numeral 47.

Figure 5:
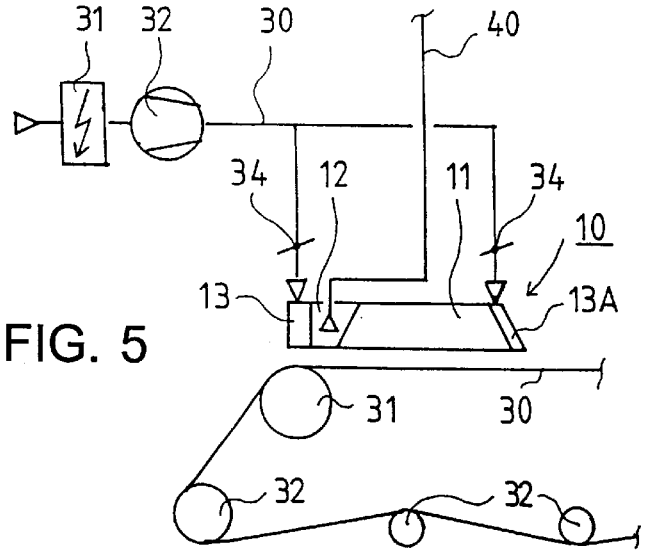
FIG. 5 schematically shows a steam box in accordance with the invention placed in connection with a fourdrinier wire.

FIG. 5 shows another embodiment of the invention, in which a steam box 10 is placed above a fourdrinier wire 30 which supports a fibrous web. A suction roll is denoted by reference numeral 31 and guide rolls of the wire 30 are denoted by reference numeral 32. The suction zone 12 is arranged at the trailing side of the steam chamber 11 of the steam box 10, from which suction zone 12, air is passed to an exhaust system 40. Blow nozzles 13,13 A are arranged at both sides of the steam box 10, i.e., at the leading side of the steam chamber 11 and at the trailing side of the suction zone 12, for blowing air toward the wire 30. The nozzle 13A is arranged to direct a blowing against the running direction of the wire 30 and the nozzle 13 is arranged to prevent spreading of steam mist. An air system 30 of the blow nozzle 13,13A comprises ducts and regulation members 34 for each blow nozzle 13,13A and a blower 32 as well as a heater 31 for heating the blowing air, thereby preventing condensation. Each blow nozzle 13,13A is also preferably provided with a double wall to prevent condensation. The blowings produced by means of the blow nozzles 13,13A prevent steam mist from being carried away from the area of the steam box 10 and, at the same time, ensure that the steam mist is passed through the suction zone 12 into the exhaust air system 40.

In the embodiments shown in FIGS. 4 and 5, the steam chamber 11, the suction zone 12 and the blow nozzle 13 or the blow nozzles 13,13A in the steam box may be formed as parts of a single frame of the steam box 10 or they may be each a separate unit, or be integrated into a framed unit, and then arranged in connection with one another to form a complete steam box 10 in accordance with the invention.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. In a steam box for increasing the removal of water from a web supported on a wire while keeping the steam box clean, the steam box including means defining a steam chamber from which steam is blown toward the web and means defining a suction zone at a trailing side of said steam chamber in a running direction of the web, said suction zone having an area of action from which steam mist is drawn into said suction zone, the improvement comprising:

means defining lateral suction zones on a respective lateral side of said steam chamber such that each of said lateral suction zones extends over a respective lateral area of the web, said lateral suction zones having an area of action from which steam mist is drawn into said lateral suction zones, and edge cutter devices arranged adjacent a respective lateral area of the web for cutting the respective lateral area of the web to form an edge of the web, each of said edge cutter devices being arranged to cut the respective lateral area of the web in at least one of said area of action of said suction zone and said area of action of said lateral suction zone extending over the respective lateral area of the web such that fibers and fillers produced during the cutting of the lateral areas of the web are drawn into said at least one of said suction zone and said lateral suction zones and do not soil the steam box.

2. The steam box of claim 1, wherein said means defining said suction zone and said means defining said lateral suction zones comprise a single frame such that a continuous suction zone is formed extending from one lateral side of said steam chamber to the trailing side of said steam chamber to the other lateral side of said steam chamber and a continuous area of action is formed extending over the lateral areas of the web and the web at the trailing side of said steam chamber.

3. The steam box of claim 1, wherein said means defining said suction zone encompass said means defining said lateral suction zones.

4. The steam box of claim 1, further comprising a first blow nozzle arranged at a trailing side of said suction zone in the running direction of the web and structured and arranged to direct a blowing of medium toward the web to prevent spreading of the steam mist and direct the steam mist into said suction zone.

5. The steam box of claim 4, wherein said first blow nozzle is structured and arranged to blow heated air.

6. The steam box of claim 4, further comprising supply means for supplying the medium to said first blow nozzle.

7. The steam box of claim 4, wherein said means defining said suction zone encompass said means defining said lateral suction zones, said means defining said steam chamber, said means defining said suction zone, said means defining said lateral suction zones and said first blow nozzle being formed in a single frame.

8. The steam box of claim 4, wherein said means defining said suction zone encompass said means defining said lateral suction zones, said means defining said steam chamber, said means defining said suction zone and said first blow nozzle being formed out of separate frames and connected together into a substantially unified frame assembly.

9. The steam box of claim 4, further comprising a second blow nozzle arranged at a leading side of said steam chamber in the running direction of the web and structured and arranged to direct a blowing of medium toward the web to prevent spreading of the steam mist.

10. The steam box of claim 9, further comprising supply means for supplying the medium to said first and second blow nozzles.

11. The steam box of claim 9, wherein said means defining said suction zone encompass said means defining said lateral suction zones, said means defining said steam chamber, said means defining said suction zone, said first blow nozzle and said second blow nozzle being formed into a single frame.

12. The steam box of claim 9, wherein said means defining said suction zone encompass said means defining said lateral suction zones, said means defining said steam chamber, said means defining said suction zone, said first blow nozzle and said second blow nozzle being formed out of separate frames and connected together into a substantially unified frame assembly.

13. A steam box for increasing the removal of water from a web supported on a wire while keeping the steam box clean, comprising means defining a steam chamber from which steam is blown toward the web, means defining a suction zone at a trailing side of said steam chamber in a running direction of the web and on lateral sides of said steam chamber such that said suction zone has an area of action from which steam mist is drawn, and edge cutter devices arranged adjacent a respective lateral area of the web for cutting the respective lateral area of the web to form an edge of the web, each of said edge cutter devices being arranged to cut the respective lateral area of the web in said area of action of said suction zone such that fibers and fillers produced during the cutting of the lateral areas of the web are drawn into said suction zone and do not soil the steam box.

14. An arrangement for removing water from a web and cutting the web, comprising a suction roll having a first suction zone through which suction is applied, a wire arranged to carry the web over said suction roll such that the web is subjected to suction in said first suction zone, and a steam box comprising means defining a steam chamber from which steam is blown toward the web, means defining a suction zone at a trailing side of said steam chamber in a running direction of the web, said suction zone having an area of action from which steam mist is drawn into said suction zone, means defining lateral suction zones on a respective lateral side of said steam chamber such that each of said lateral suction zones extends over a respective lateral area of the web, said lateral suction zones having an area of action from which steam mist is drawn into said lateral suction zones, and edge cutter devices arranged adjacent a respective lateral area of the web for cutting the respective lateral area of the web to form an edge of the web, each of said edge cutter devices being arranged to cut the respective lateral area of the web in at least one of said area of action of said suction zone and said area of action of said lateral suction zone extending over the respective lateral area of the web such that fibers and fillers produced during the cutting of the lateral areas of the web are drawn into said at least one of said suction zone and said lateral suction zones and do not soil the steam box.

15. An arrangement for removing water from a web and cutting the web, comprising a suction flatbox arranged to applying suction, a wire arranged to carry the web over said suction flatbox such that the web is subjected to the suction applied by said suction flatbox, and a steam box comprising means defining a steam chamber from which steam is blown toward the web, means defining a suction zone at a trailing side of said steam chamber in a running direction of the web, said suction zone having an area of action from which steam mist is drawn into said suction zone, means defining lateral suction zones on a respective lateral side of said steam chamber such that each of said lateral suction zones extends over a respective lateral area of the web, said lateral suction zones having an area of action from which steam mist is drawn into said lateral suction zones, and edge cutter devices arranged adjacent a respective lateral area of the web for cutting the respective lateral area of the web to form an edge of the web, each of said edge cutter devices being arranged to cut the respective lateral area of the web in at least one of said area of action of said suction zone and said area of action of said lateral suction zone extending over the respective lateral area of the web such that fibers and fillers produced during the cutting of the lateral areas of the web are drawn into said at least one of said suction zone and said lateral suction zones and do not soil the steam box.

* * * * *